US008099867B2

(12) United States Patent
Patel et al.

(10) Patent No.: US 8,099,867 B2
(45) **Date of Patent: *Jan. 24, 2012**

(54) METHOD FOR MANUFACTURING OF FUEL NOZZLE FLOATING COLLAR

(75) Inventors: Bhawan B. Patel, Mississauga (CA); Lorin Markarian, Etobicoke (CA); Melissa Despres, Verdun (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 285 days.

This patent is subject to a terminal disclaimer.

(21) Appl. No.: 12/434,701

(22) Filed: May 4, 2009

(65) Prior Publication Data

US 2009/0211097 A1 Aug. 27, 2009

Related U.S. Application Data

(62) Division of application No. 11/782,234, filed on Jul. 24, 2007, now Pat. No. 7,543,383.

(51) Int. Cl.
*B21K 21/08* (2006.01)
*B22D 17/00* (2006.01)

(52) U.S. Cl. ..... 29/890.142; 29/890.14; 29/418; 29/423; 29/527.1; 164/113; 164/303

(58) Field of Classification Search ..... 29/890.143, 29/890.142, 889.2, 423, 418, 527.1; 164/113, 164/303; 60/737, 748
See application file for complete search history.

(56) References Cited

U.S. PATENT DOCUMENTS 7,140,189 B2 * 11/2006 Markarian et al. ..... 60/796
7,237,730 B2 * 7/2007 Prociw et al. ..... 239/406
7,543,383 B2 * 6/2009 Patel et al. ..... 29/890.142

FOREIGN PATENT DOCUMENTS

JP 2000158426 A * 6/2000

* cited by examiner

*Primary Examiner* — Sarang Afzali
(74) *Attorney, Agent, or Firm* — Norton Rose OR LLP

(57) ABSTRACT

A floating collar is metal injected molded with an excess portion intended to be separated, such as by shearing, from the reminder of the molded floating collar to leave a chamfer thereon and/or remove injection marks.

8 Claims, 6 Drawing Sheets

METHOD FOR MANUFACTURING OF FUEL NOZZLE FLOATING COLLAR

CROSS-REFERENCE TO RELATED APPLICATIONS

The present application is a divisional application of application Ser. No. 11/782,234, filed Jul. 24, 2007, now U.S. Pat. No. 7,543,383 issued on Jun. 9, 2009.

TECHNICAL FIELD

The application relates generally to gas turbine engine combustors and, more particularly, to a method of manufacturing a fuel nozzle floating collar therefor.

BACKGROUND OF THE ART

Gas turbine combustors are typically provided with floating collar assemblies or seals to permit relative radial or lateral motion between the combustor and the fuel nozzle while minimizing leakage therebetween. Machined floating collars are expensive to manufacture at least partly due to the need for an anti-rotating tang or the like to prevent rotation of the collar about the fuel nozzle tip. This anti-rotation feature usually prevents the part from being simply turned requiring relatively expensive milling operations and results in relatively large amount of scrap material during machining.

There is thus a need for further improvements in the manufacture of fuel nozzle floating collars.

SUMMARY

In one aspect, there is provided a method of manufacturing a floating collar adapted to be slidably engaged on a fuel nozzle for providing a sealing interface between the fuel nozzle and a combustor wall, the method comprising: metal injection moulding a generally cylindrical part having an axis, a collar portion and a sacrificial portion, the sacrificial portion including at least a shoulder projecting radially inwardly from one end of said collar portion along an inner circumferential wall of the collar portion, the shoulder and the circumferential wall defining a corner, and while the cylindrical part is still in a substantially dry green condition, forming a chamfer at said one end of said collar portion on an inside diameter of the collar portion by applying axially opposed shear forces on opposed sides of the corner to shear off the sacrificial portion from said collar portion along a shearing line extending angularly outwardly from said corner.

In a second aspect, there is provided a method for manufacturing a floating collar adapted to provide a sealing interface between a fuel nozzle and a gas turbine engine combustor, comprising: a) metal injection moulding a green part including a floating collar portion and a feed inlet portion, the feed inlet portion bearing injection marks corresponding to the points of injection, b) separating the feed inlet portion from the floating collar portion to obtain a floating collar free of any injection marks, and c) debinding and sintering the floating collar portion Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
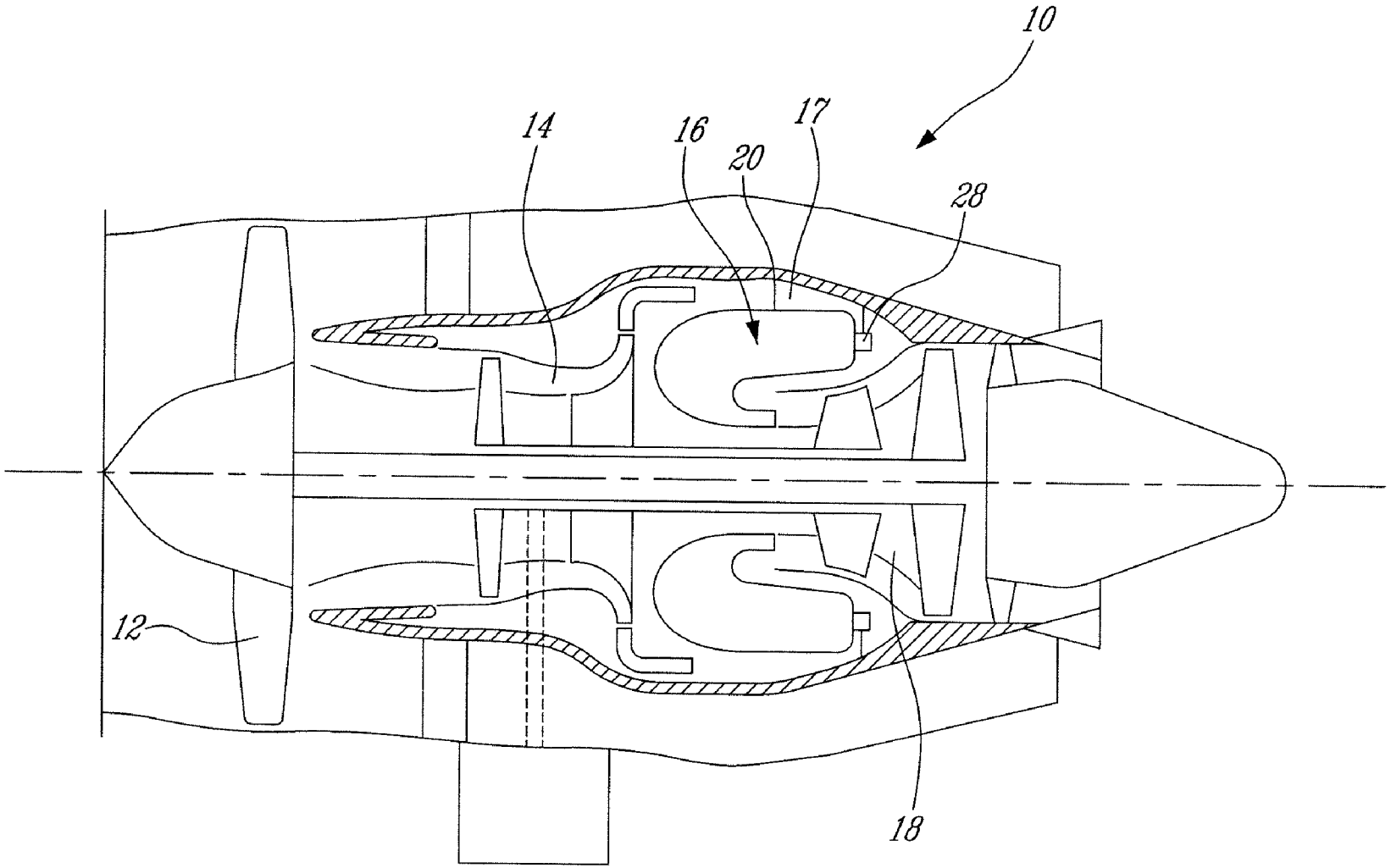
FIG. 1 is a schematic cross-sectional view of a gas turbine engine having an annular combustor.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
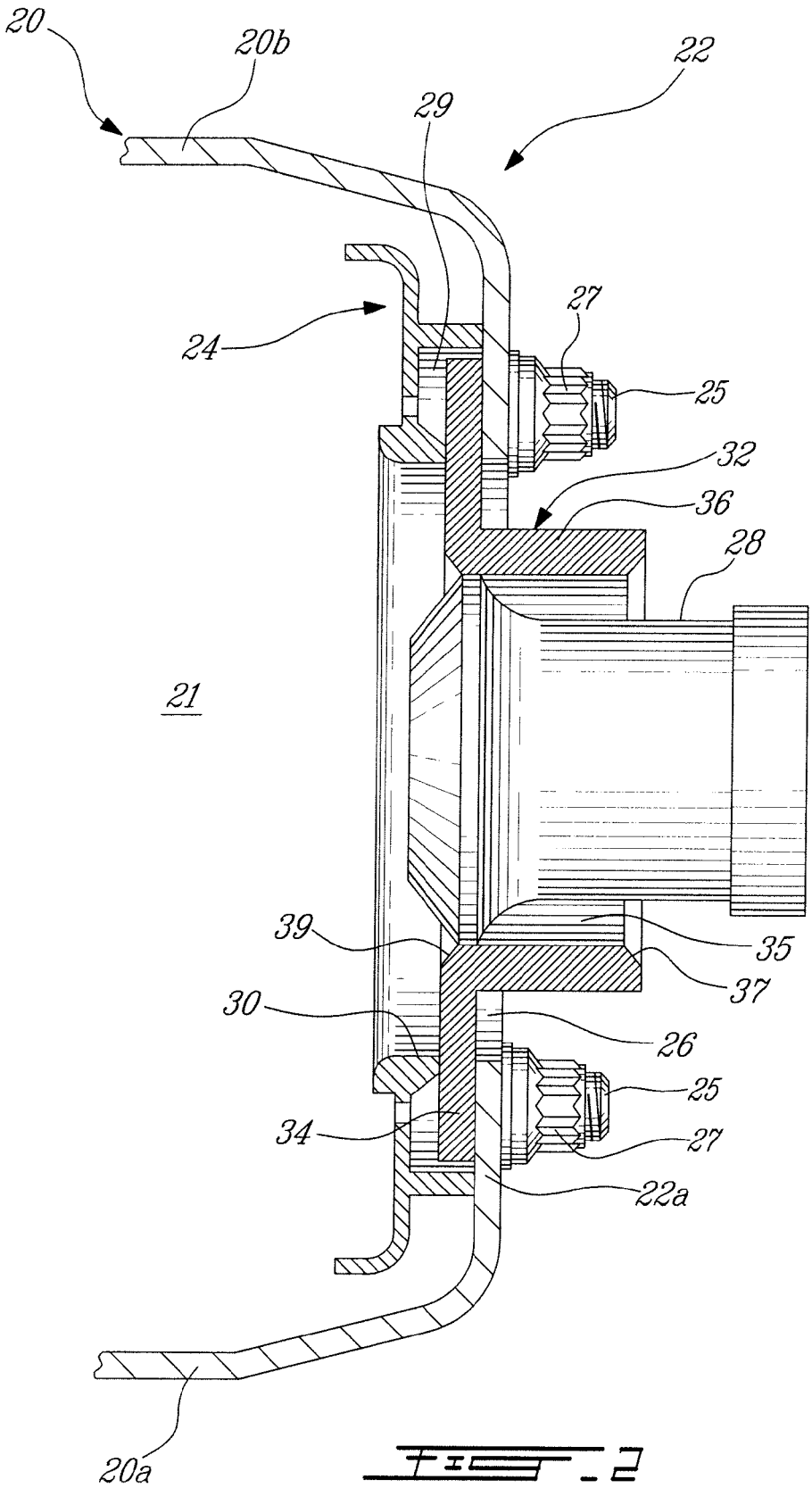
FIG. 2 is an enlarged cross-sectional view of a dome portion of the combustor illustrating a floating collar slidably mounted about a fuel nozzle tip and axially trapped between a heat shield and a combustor dome panel.

The combustor 16 is housed in a plenum 17 supplied with compressed air from compressor 14. The combustor 16 has a reverse flow annular combustor shell 20 including a radially inner liner 20*a* and a radially outer liner 20*b* defining a combustion chamber 21. As shown in FIG. 2, the combustor shell 20 has a bulkhead or inlet dome portion 22 including an annular end wall or dome panel 22*a*. A plurality of circumferentially distributed dome heat shields (only one being shown at 24) are mounted inside the combustor 16 to protect the dome panel 22*a* from the high temperatures in the combustion chamber 21. The heat shields 24 can be provided in the form of high temperature resistant casting-made arcuate segments assembled end-to-end to form a continuous 360° annular band on the inner surface of the dome panel 22*a*. Each heat shield 24 has a plurality of threaded studs 25 extending from a back face thereof and through corresponding mounting holes defined in the dome panel 22*a*. Fasteners, such as self-locking nuts 27, are threadably engaged on the studs from outside of the combustor 16 for securely mounting the dome heat shields 24 to the dome panel 22*a*. As shown in FIG. 2, the heat shields 24 are spaced from the dome panel 22*a* by a distance of about 0.1 inch so as to define an air gap 29. In use, cooling air is admitted in the air gap 29 via impingement holes (not shown) defined though the dome panel 22*a* in order to cool down the heat shields 24.

A plurality of circumferentially distributed nozzle openings (only one being shown at 26) are defined in the dome panel 22*a* for receiving a corresponding plurality of air swirler fuel nozzles (only one being shown at 28) adapted to deliver a fuel-air mixture to the combustion chamber 21. A corresponding central circular hole 30 is defined in each of the heat shields 24 and is aligned with a corresponding fuel nozzle opening 26 for accommodating an associated fuel nozzle 28 therein. The fuel nozzles 28 can be of the type generally described in U.S. Pat. Nos. 6,289,676 or 6,082,113, for example, and which are incorporated herein by reference.

Figure 3:
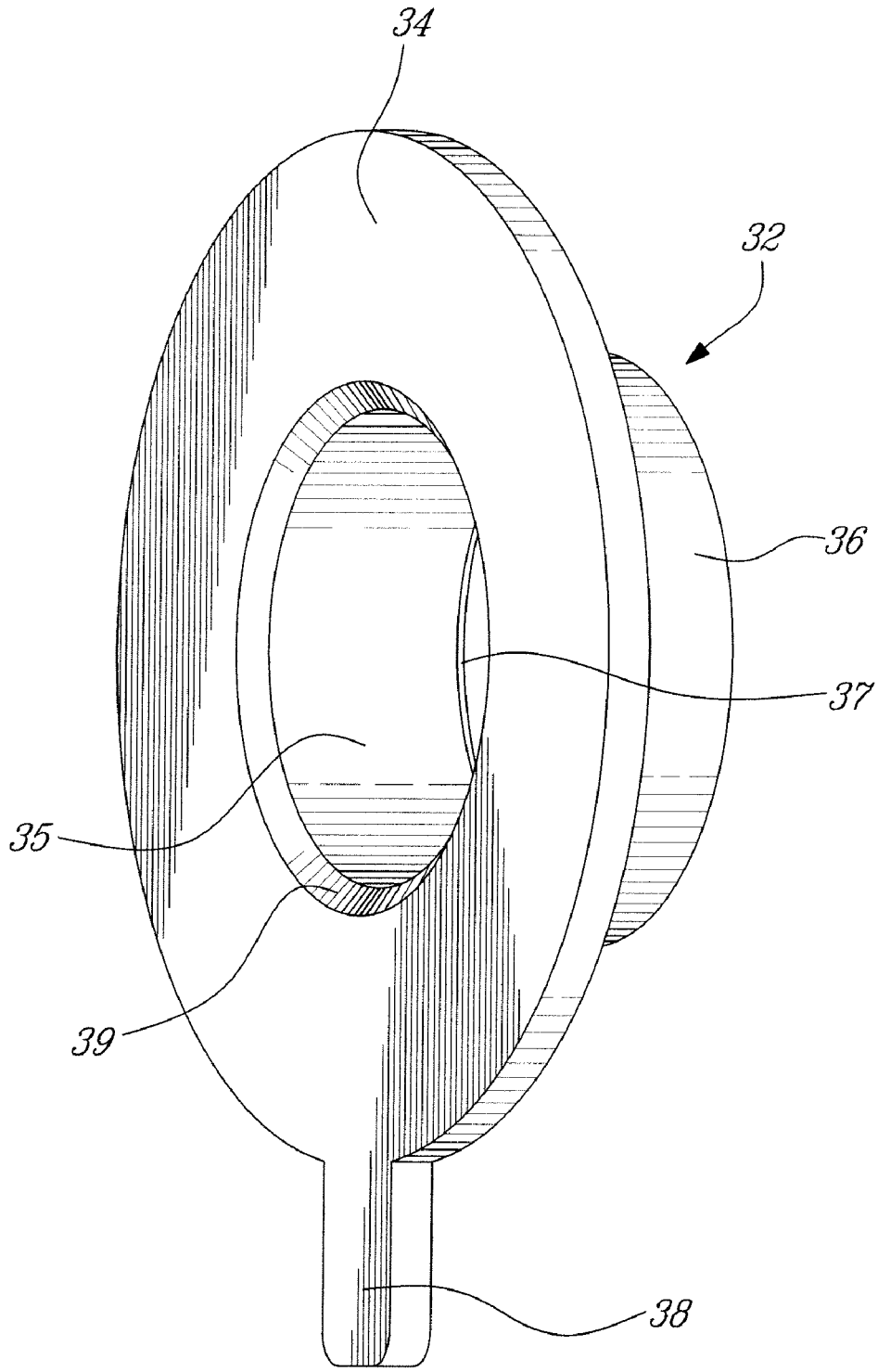
FIG. 3 is an isometric view of the floating collar shown in FIG. 2.

As shown in FIGS. 2 and 3, each fuel nozzle 28 is associated with a floating collar 32 to facilitate fuel nozzle engagement with minimum air leakage while maintaining relative movement of the combustor 16 and the fuel nozzle 28. Each floating collar 32 comprises an axially extending cylindrical portion 36 and a radially extending flange portion 34 integrally provided at a front end of the axially extending cylindrical portion 36. The axially extending cylindrical portion 36 defines a central passage 35 for allowing the collar 32 to be axially slidably engaged on the tip portion of the fuel nozzle 28. First and second inner diameter chamfers 37 and 39 are provided at opposed ends of the collar 32 to eliminate any sharp edges that could interfere with the sliding movement of the collar 32 on the fuel nozzle 28. The chamfers 37 and 39 extend all around the inner circumference of the collar 32. The radially extending flange portion 34 is axially sandwiched in the air gap 29 between the heat shield 24 and the dome panel 22*a*. An anti-rotation tang 38 extends radially from flange portion 34 for engagement in a corresponding slot (not shown) defined in a rearwardly projecting surface of the heat shield 24.

Figure 4:
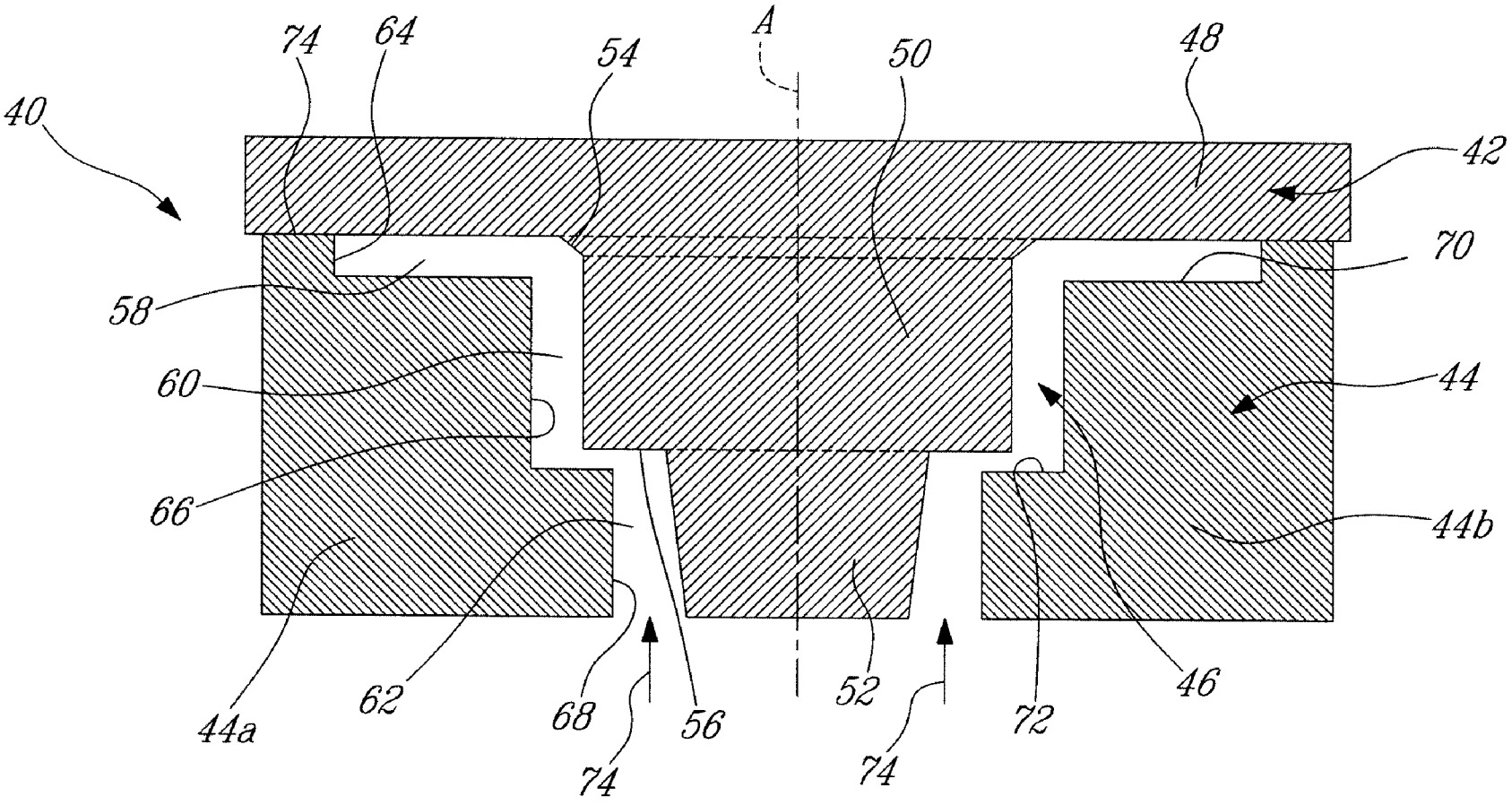
FIG. 4 is a cross-sectional view of a mould used to form the floating collar.

As can be appreciated from FIG. 4, the floating collar 32 can be produced by metal injection moulding (MIM). The MIM process is preferred as being a cost-effective method of forming precise net-shape metal components. The MIM process eliminates costly secondary machining operations. The manufacturing costs can thus be reduced. The floating collar 32 is made from a high temperature resistant powder injection moulding composition. Such a composition can include powder metal alloys, such as IN625 Nickel alloy, or ceramic powders or mixtures thereof mixed with an appropriate binding agent. Other high temperature resistant compositions could be used as well. Other additives may be present in the composition to enhance the mechanical properties of the floating collar (e.g. coupling and strength enhancing agents).

As shown in FIG. 4, the molten metal slurry used to form the floating collar 32 is injected in a mould assembly 40 comprising a one-piece male part 42 axially insertable into a two-piece female part 44. The metal slurry is injected in a mould cavity 46 defined between the male part 42 and the female part 44. The gap between the male and female parts 42 and 44 corresponds to the desired thickness of the walls of the floating collar 32. The female part 44 is preferably provided in the form of two separable semi-cylindrical halves 44*a* and 44*b* to permit easy unmoulding of the moulded green part.

The male part 42 has a disc-shaped portion 48, an intermediate cylindrical portion 50 projecting axially centrally from the disc-shaped portion 48 and a terminal frusto-conical portion 52 projecting axially centrally from the intermediate cylindrical portion 50 and tapering in a direction away from the intermediate cylindrical portion 50. An annular chamfer 54 is defined in the male part 42 between the disc-shaped portion 48 and the intermediate cylindrical portion 50. The annular chamfer 54 is provided to form the inner diameter chamfer 39 of the collar 32. An annular shoulder 56 is defined between the intermediate cylindrical portion 50 and the bottom frusto-conical portion 52.

The female part 44 defines a central stepped cavity including a rear shallow disc-like shaped cavity 58, a cylindrical intermediate cavity 60 and a front or feed inlet cylindrical cavity 62. The disc-like shaped cavity 58, the intermediate cavity 60 and the feed cavity 62 are aligned along a central common axis A. The disc-like shaped cavity 58 has a diameter d1 greater than the diameter d2 of the intermediate cavity 60. Diameter d2 is, in turn, greater than the diameter d3 of the feed cavity 62. The disc-like shaped cavity 58, the intermediate cavity 60 and the feed cavity 62 are respectively circumscribed by concentric cylindrical sidewalls 64, 66 and 68. First and second axially spaced-apart annular shoulders 70 and 72 are respectively provided between the disc-like cavity 58 and the intermediate cavity 60, and the intermediate cavity 60 and the front cavity 62.

After the male part 42 and the female part 44 have been inserted into one another with a peripheral portion of the disc-like shaped portion 48 of the male part 42 sealingly abutting against a corresponding annular surface 74 of the female part 44, the mould cavity 46 is filled with the feedstock (i.e. the metal slurry) by injecting the feedstock axially endwise though the feed cavity 62 about the frusto-conical portion 52, as depicted by arrows 74.

Figure 5:
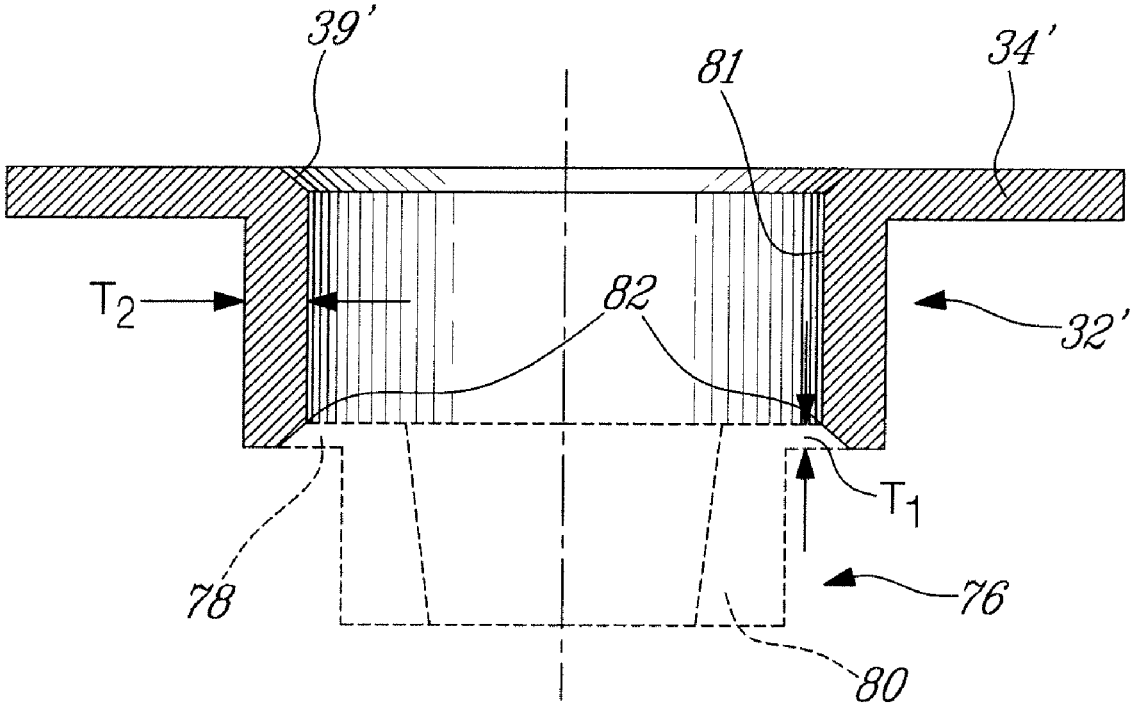
FIG. 5 is a cross-sectional view of the moulded green part obtained from the metal injection moulding operation, the feed inlet material to be discarded being shown in dotted lines.

After a predetermined setting period, the mould assembly 40 is opened to reveal the moulded green part shown in FIG. 5. The moulded green part comprises a floating collar portion 32' and a sacrificial or "discardeable" feed inlet portion 76 (shown in dotted lines) to be separated from the collar portion 32' and discarded. As can be appreciated from FIG. 5, the collar portion 32' has a built-in flange 34' and an inner diameter chamfer 39' respectively corresponding to flange 34 and chamfer 39 on the finished collar product shown in FIG. 3, but still missed the inner diameter chamfer 37 at the opposed end of the floating collar. As will be seen hereinafter, the chamfer 37 is subsequently formed by separating the sacrificial portion 76 from the collar portion 32'.

In the illustrated example, the sacrificial feed inlet portion 76 comprises a shoulder 78 extending radially inwardly from one end of the collar portion 32' opposite to flange 34' and an axially projecting hollow cylindrical part 80. The shoulder 78 extends all around the entire inner circumference of the collar portion 32'. The shoulder 78 and the cylindrical wall 81 of the collar portion 32' define a sharp inner corner 82. The sharp inner corner 82 is a high stress concentration region where the moulded green part will first start to crack if a sufficient load is applied on shoulder 78. Also can be appreciated from FIG. 5, the thickness T1 of the shoulder 78 is less than the wall thickness T2 of the collar portion 32'. The shoulder 78 is thus weaker than the cylindrical wall 81 of the collar 32', thereby providing a suitable "frangible" or "breakable" area for separating the sacrificial feed inlet portion 76 from the collar portion 32'.

Figure 6:
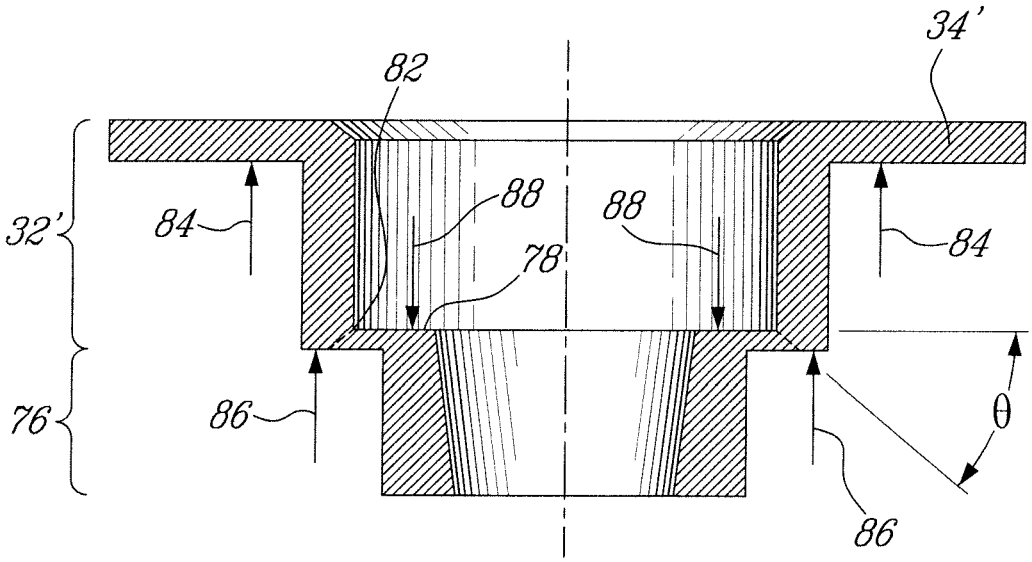
FIG. 6 is a cross-sectional schematic view illustrating how the moulded green part is sheared to separate the collar from the material to be discarded.

As schematically shown in FIG. 6, the sacrificial feed inlet portion 76 can be separated from the collar portion 32' by shearing. The shearing operation is preferably conducted while the part is still in a dry green state. In this state, the part is brittle and can therefore be broken into pieces using relatively small forces. As schematically depicted by arrows 84 and 86, the moulded green part is uniformly circumferentially supported underneath flange 34' and shoulder 78. An axially downward load 88 is applied at right angles on the inner shoulder 78 uniformly all along the circumference thereof. A conventional flat headed punch (not shown) can be used to apply load 88. The load 88 or shearing force is applied next to inner corner 82 and is calibrated to shear off the sacrificial portion 80 from the collar portion 32'. As shown in dotted lines in FIG. 6, the crack initiates from the corner 88 due to high stress concentration and extends angularly outwardly towards the outer support 86 at an angle θ comprised between 40-50 degrees, thereby leaving a sheared chamfer 37' (see FIG. 7) on the inner diameter of the separated collar portion 32'. The shear angle θ can be adjusted by changing the diameter of the outer support 86. For instance, if the diameter of the outer support 86 is reduced so as to be closer to the inner corner 82, the shear angle θ will increase. Accordingly, the location of the intended shear line can be predetermined to consistently and repeatedly obtain the desired inner chamfer at the end of the MIM floating collars. This avoids expensive secondary machining operations to form chamfer 37. The sheared chamfer 37 has a surface finish which is a rougher than a machined or moulded surface, but is designed to remain within the prescribed tolerances. There is thus no need to smooth out the surface finish of the sheared chamfer 37. Also, since the sacrificial portion 76 bears the injection marks left in the moulded part at the points of injection, there is no need for secondary machining of the remaining collar portion 32' in order to remove the injection marks.

Figure 7:
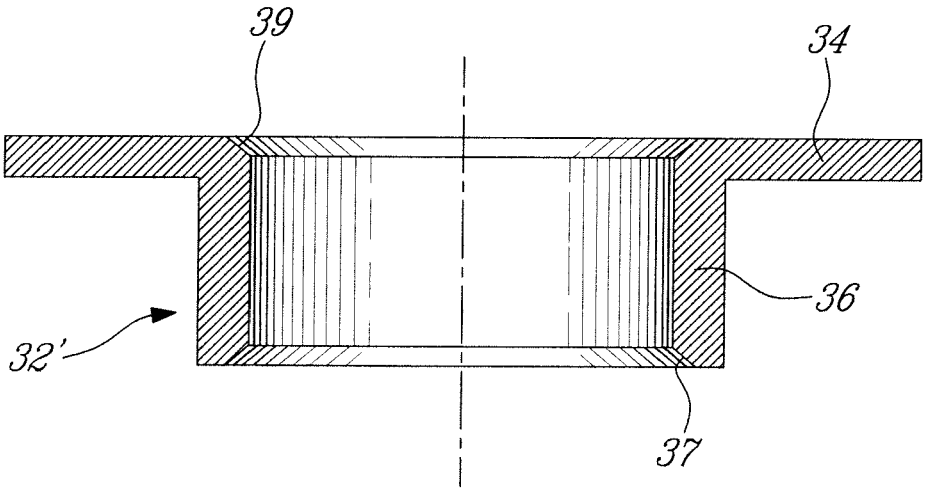
FIG. 7 is a cross-section view of the collar after the shearing operation, the sheared surface forming a chamfer on the inside diameter of the collar.

Once separated from the collar portion 32', the sacrificial feed inlet portion 76 can be recycled by mixing with the next batch of metal slurry. The remaining collar portion 32' obtained from the shearing operation is shown in FIG. 7 and is then subject to conventional debinding and sintering operations in order to obtain the final net shape part shown in FIG. 3.

The above description is meant to be exemplary only, and one skilled in the art will recognize that changes may be made to the embodiments described without departing from the scope of the invention disclosed. For example, a line of weakening could be integrally moulded into the part or cut into the surface of the moulded part to provide a stress concentration region or frangible interconnection between the portion to be discarded and the floating collar portion. Also, it is understood that the part to be discarded could have various configurations and is thus limited to the configuration exemplified in FIGS. 5 and 6. Still other modifications which fall within the scope of the present invention will be apparent to those skilled in the art, in light of a review of this disclosure, and such modifications are intended to fall within the appended claims.

What is claimed is:

1. A method for manufacturing a floating collar adapted to provide a sealing interface between a fuel nozzle and a gas turbine engine combustor, comprising: a) metal injection moulding a green part including a floating collar portion and a feed inlet portion, the floating collar portion being integrally connected to the feed inlet portion via a stress concentration zone, the feed inlet portion bearing injection marks corresponding to points of injection, b) separating the feed inlet portion from the floating collar portion to obtain a floating collar free of any injection marks, including shearing said green part along said stress concentration zone and then c) debinding and sintering the floating collar portion.

2. The method as defined in claim 1, wherein said stress concentration zone is formed during moulding.

3. The method as defined in claim 2, wherein providing the stress concentration comprises forming a corner between said floating collar portion and said feed inlet portion.

4. The method as defined in claim 3, wherein the floating collar portion comprises an axially extending cylindrical wall, the feed inlet portion comprises a shoulder extending radially inwardly from one end of said axially extending cylindrical wall, the corner being defined between said shoulder and said cylindrical wall, and wherein separating said floating collar portion from said feed inlet portion comprises applying axially opposed shear forces next to said corner.

5. The method as defined in claim 4, wherein applying axially opposed shear forces comprises applying an axial load on said shoulder while axially supporting said one end of said axially extending cylindrical wall of said floating collar portion radially outwardly of said corner to provide reaction forces to the applied load.

6. The method as defined in claim 1, wherein said feed inlet portion and said floating collar portion are separated by shearing.

7. The method as defined in claim 1, wherein said feed inlet portion extends from a first end of said floating collar portion, and wherein step b) comprises chamfering an inside diameter of the first end of the floating collar portion.

8. The method as defined in claim 1, wherein said floating collar portion has a circumferential wall having a thickness $T_2$, said feed inlet portion having a shoulder projecting from one end of said circumferential wall, said shoulder having a thickness $T_1$ which is less than the thickness $T_2$.

* * * * *